US009995145B2

(12) United States Patent
Propheter-Hinckley et al.

(10) Patent No.: US 9,995,145 B2
(45) Date of Patent: Jun. 12, 2018

(54) DRILL TO FLOW MINI CORE

(71) Applicant: UNITED TECHNOLOGIES CORPORATION, Hartford, CT (US)

(72) Inventors: Tracy A Propheter-Hinckley, Manchester, CT (US); Stephanie Santoro, Wolcott, CT (US)

(73) Assignee: United Technologies Corporation, Farmington, CT (US)

( * ) Notice: Subject to any disclaimer, the term of this patent is extended or adjusted under 35 U.S.C. 154(b) by 140 days.

(21) Appl. No.: 14/526,860

(22) Filed: Oct. 29, 2014

(65) Prior Publication Data

US 2016/0153280 A1 Jun. 2, 2016

Related U.S. Application Data

(62) Division of application No. 12/975,404, filed on Dec. 22, 2010, now Pat. No. 8,944,141.

(51) Int. Cl.

| | |
|---|---|
| ***F01D 5/18*** | (2006.01) |
| ***F01D 9/04*** | (2006.01) |
| ***B22D 25/02*** | (2006.01) |

(52) U.S. Cl.

CPC ..... *F01D 5/18* (2013.01); *B22D 25/02* (2013.01); *F01D 5/186* (2013.01); *F01D 9/041* (2013.01);

(Continued)

(58) Field of Classification Search

CPC ..... F05D 2260/204

See application file for complete search history.

(56) References Cited

U.S. PATENT DOCUMENTS

| | | | |
|---|---|---|---|
| 3,819,295 | A | 6/1974 | Hauser et al. |
| 5,243,759 | A | 9/1993 | Brown et al. |

(Continued)

FOREIGN PATENT DOCUMENTS

| | | |
|---|---|---|
| EP | 1091091 | 4/2001 |
| EP | 1091092 | 4/2001 |

(Continued)

OTHER PUBLICATIONS

European Search Report dated Apr. 4, 2017 for Application No. 11195310.5.

*Primary Examiner* — Justin Seabe
*Assistant Examiner* — Juan G Flores
(74) *Attorney, Agent, or Firm* — Bachman & LaPointe, P.C.

(57) ABSTRACT

A process for providing cooling fluid holes in an airfoil portion of a turbine engine component comprising: positioning a first core with metering/tripping features that form a row of protrusions, and teardrop features that form a fluid passageways, the teardrop features including a central teardrop feature having a trailing edge, a first teardrop feature located on a first side of and spaced from the central teardrop feature, the first teardrop feature having a longitudinal axis and being non-symmetrical about the longitudinal axis, and a second teardrop feature located on a second side of and spaced from the central teardrop feature, the second teardrop feature having a longitudinal axis and non-symmetrical about the longitudinal axis; joining the core to a ceramic core; forming the turbine engine component; removing the core, forming a cooling microcircuit with fluid outlets; and drilling a central portion of the cooling microcircuit forming a converging/diverging outlet.

1 Claim, 4 Drawing Sheets

(52) U.S. Cl.
CPC .. *F05D 2250/185* (2013.01); *F05D 2260/202* (2013.01); *F05D 2260/204* (2013.01); *Y10T 29/49337* (2015.01)

(56) References Cited

U.S. PATENT DOCUMENTS

| | | | | |
|---|---|---|---|---|
| 5,392,515 | A * | 2/1995 | Auxier | B23P 15/04 29/463 |
| 6,158,223 | A | 12/2000 | Mandai et al. | |
| 6,179,565 | B1 | 1/2001 | Palumbo et al. | |
| 6,634,175 | B1 | 10/2003 | Kawata et al. | |
| 7,311,498 | B2 | 12/2007 | Cunha et al. | |
| 7,731,481 | B2 | 6/2010 | Cunha et al. | |
| 7,815,414 | B2 * | 10/2010 | Devore | F01D 5/186 415/115 |
| 8,317,475 | B1 * | 11/2012 | Downs | F01D 5/186 416/97 R |
| 2005/0053459 | A1 | 3/2005 | Cunha et al. | |
| 2005/0169754 | A1 | 8/2005 | Surace et al. | |
| 2005/0191167 | A1 | 9/2005 | Mongillo et al. | |
| 2005/0232768 | A1 | 10/2005 | Heeg et al. | |
| 2008/0110024 | A1 | 5/2008 | Reilly et al. | |
| 2008/0286115 | A1 | 11/2008 | Liang | |
| 2009/0169394 | A1 * | 7/2009 | Crow | B23H 9/10 416/96 R |

FOREIGN PATENT DOCUMENTS

| | | |
|---|---|---|
| EP | 1531019 | 5/2005 |
| EP | 1808574 | 7/2007 |
| EP | 1865152 | 12/2007 |
| EP | 2143883 | 1/2010 |

* cited by examiner

DRILL TO FLOW MINI CORE

CROSS REFERENCE TO RELATED APPLICATION(S)

This application is a divisional application of pending U.S. patent application Ser. No. 12/975,404, filed Dec. 22, 2010, entitled "Drill to Flow Mini Core".

STATEMENT OF GOVERNMENT INTEREST

The Government of the United States of America may have rights in the present invention as a result of Contract No. N00019-02-C-3003 awarded by the Department of the Navy.

BACKGROUND

The present disclosure relates to a core which may be used to form a cooling microcircuit in an airfoil portion of a turbine engine component, which core is configured to allow the formation of a central fluid outlet which has a converging/diverging configuration and to a process of utilizing the core.

The fabrication of certain turbine engine components requires the use of a thin core. The thin core may be placed between a ceramic core which is used to form a central cooling fluid passageway in an airfoil portion of the turbine engine component and a region where an external wall of the airfoil portion will be created. The use of such a core creates a cooling circuit configuration which allows for film cooling. The thin cores can be made of either ceramic or a refractory metal material.

While highly useful, there exists the reality that the cores are a product of the dies used to fabricate them. Initially, dies are made with a theorized wear factor. For example, the cores are artificially made small in order to account for the fact that as the rough material forming the core is injected into the die time and again, the cores would effectively grow. Often, this fluctuation is not as expected and the dies need to be replaced sooner to prevent the formation of cores which do not meet desired specifications. Further, as the dies wear and cores which do not meet the specifications are formed, it becomes difficult to control the outflow from the turbine engine component whose cooling microcircuit(s) are formed using the core.

To date, these problems have not been fully addressed.

SUMMARY

In accordance with the instant disclosure, there is provided a core for forming a cooling microcircuit which broadly comprises at least one row of metering/tripping features configured to form at least one row of protrusions in said cooling microcircuit, a plurality of teardrop features configured to form a plurality of fluid passageways in said cooling microcircuit, a terminal edge, said plurality of teardrop features including a central teardrop feature having a trailing edge which is spaced from said terminal edge, and said plurality of teardrop features including a first teardrop feature located on a first side of and spaced from said central teardrop feature, said first teardrop feature having a longitudinal axis and being non-symmetrical about said longitudinal axis.

Further, there is provided a process for providing cooling microcircuits in an airfoil portion of a turbine engine component comprising the steps of: positioning at least one first core having at least one row of metering/tripping features configured to form at least one row of protrusions in said cooling microcircuit, and a plurality of teardrop features configured to form a plurality of fluid passageways in said cooling microcircuit, said plurality of teardrop features including a central teardrop feature having a trailing edge, a first teardrop feature located on a first side of and spaced from said central teardrop feature, said first teardrop feature having a longitudinal axis and being non-symmetrical about said longitudinal axis, and a second teardrop feature located on a second side of and spaced from said central teardrop feature, said second teardrop feature having a longitudinal axis and being non-symmetrical about said longitudinal axis; joining said at least one core to at least one ceramic core; forming said turbine engine component; removing said at least one core to form a cooling microcircuit having a plurality of fluid outlets; and drilling a central portion of said cooling microcircuit so as to form a cooling fluid outlet having a converging/diverging configuration.

Also, there is provided a turbine engine component having an airfoil portion and at least one cooling microcircuit located within a wall of said airfoil portion, each said cooling microcircuit having a plurality of fluid outlets with a central one of said fluid outlets having a converging/diverging configuration.

Other details of the drill to flow mini core described herein are set forth in the following detailed description and the accompanying drawings wherein like reference numerals depict like elements.

DETAILED DESCRIPTION

Figure 1:
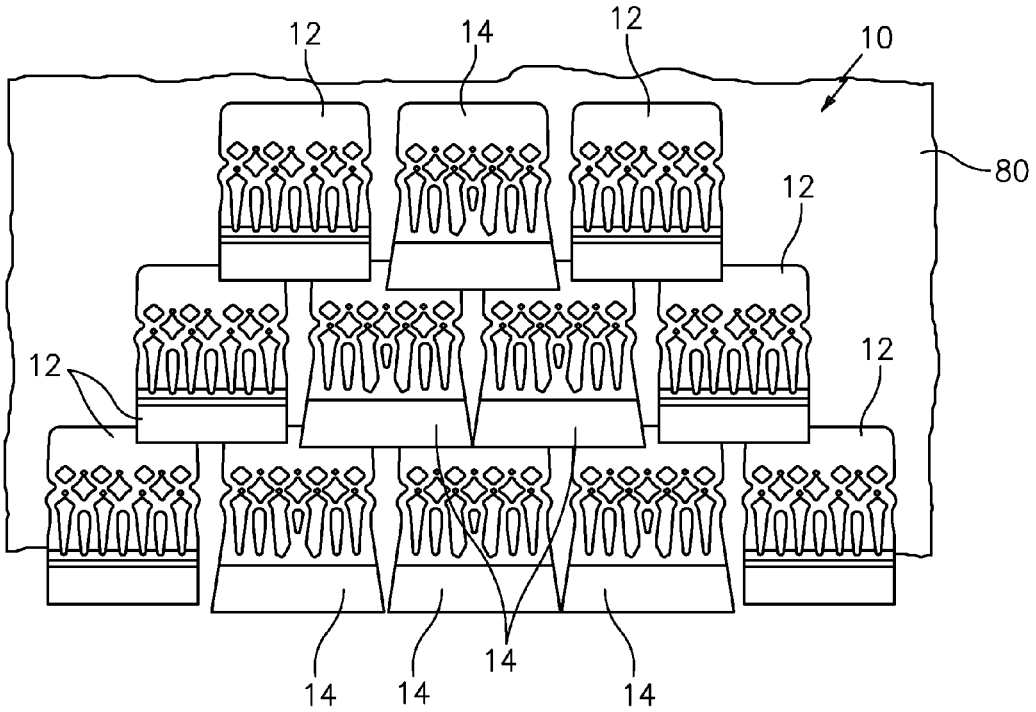
FIG. 1 illustrates an array of cores to be used to form an array of cooling circuits.

FIG. 1 illustrates an array 10 of cores 12 and 14 which may be used to form an array of cooling circuits in an airfoil portion of a turbine engine component. The array 10 includes a plurality of cores 12 having the design shown in FIGS. 2 and 3 and a plurality of cores 14 having the design shown in FIG. 4. The figure also shows a ceramic core 80 which is used to form one or more internal cavities.

Figure 2:
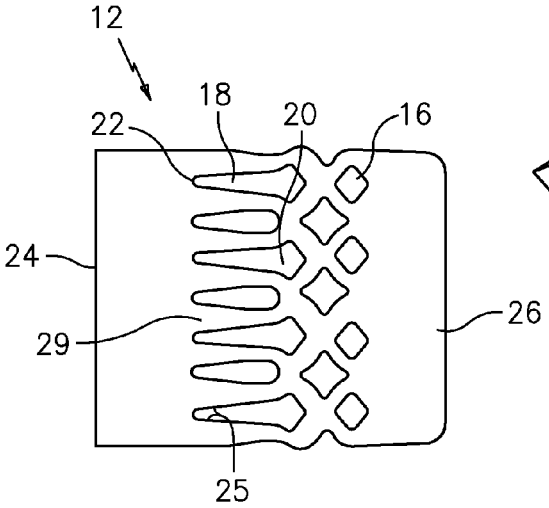
FIG. 2 illustrates a first embodiment of a core for forming a cooling circuit.
Figure 3:
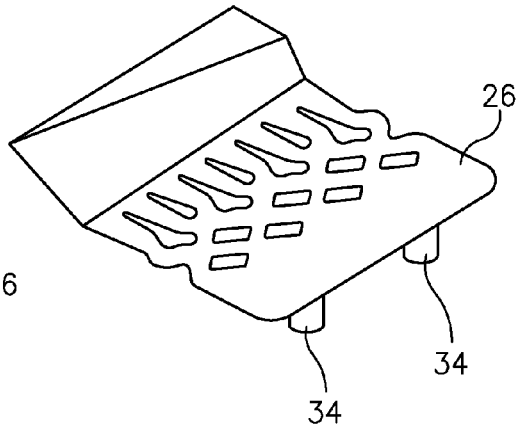
FIG. 3 is an end view of the core of FIG. 2.

Referring now to FIGS. 2 and 3, there is shown one of the cores 12 to be used for forming a cooling circuit within the walls of the airfoil portion of the turbine engine component. The core 12 has an array of metering/tripping features 16 in the form of rows of shaped slots. The metering/tripping features 16 form a plurality of protrusions in the cooling microcircuit, which protrusions create turbulence in the cooling air flow.

The core 12 further includes a plurality of teardrop features 18 also in the form of slots having a teardrop or near teardrop shape. Each of the teardrop features 18 has a longitudinal axis 20 and is symmetrical about the longitudinal axis 20. Further, each of the teardrop features 18 has a trailing edge 22 which ends a distance from a line 24 where the core 12 meets an airfoil wall. Each of the teardrop features 18 has a converging wall portion 25. The space between the teardrop features 18 forms a series of outlet passages 29 having diverging walls, which outlet passages terminate in a series of film cooling holes 31 (see FIG. 5).

The core 12 further has a portion 34 which forms entrances for allowing the cooling fluid to enter the cooling microcircuit. The core 12 has a portion 26 which forms a plenum area between the entrance forming portion 24 and the metering/tripping features 16.

When the part is manufactured, cooling air flow from the main body core enters through a number of entrances formed by the portion 34 into the plenum area 26. The cooling air flow then passes through a series of passageways formed by protrusions created by the metering/tripping features 16 and finally through the fluid passageways formed by the teardrop features 18 where the cooling air expands prior to exiting onto the external surface of the airfoil via film cooling holes 31.

Figure 4:
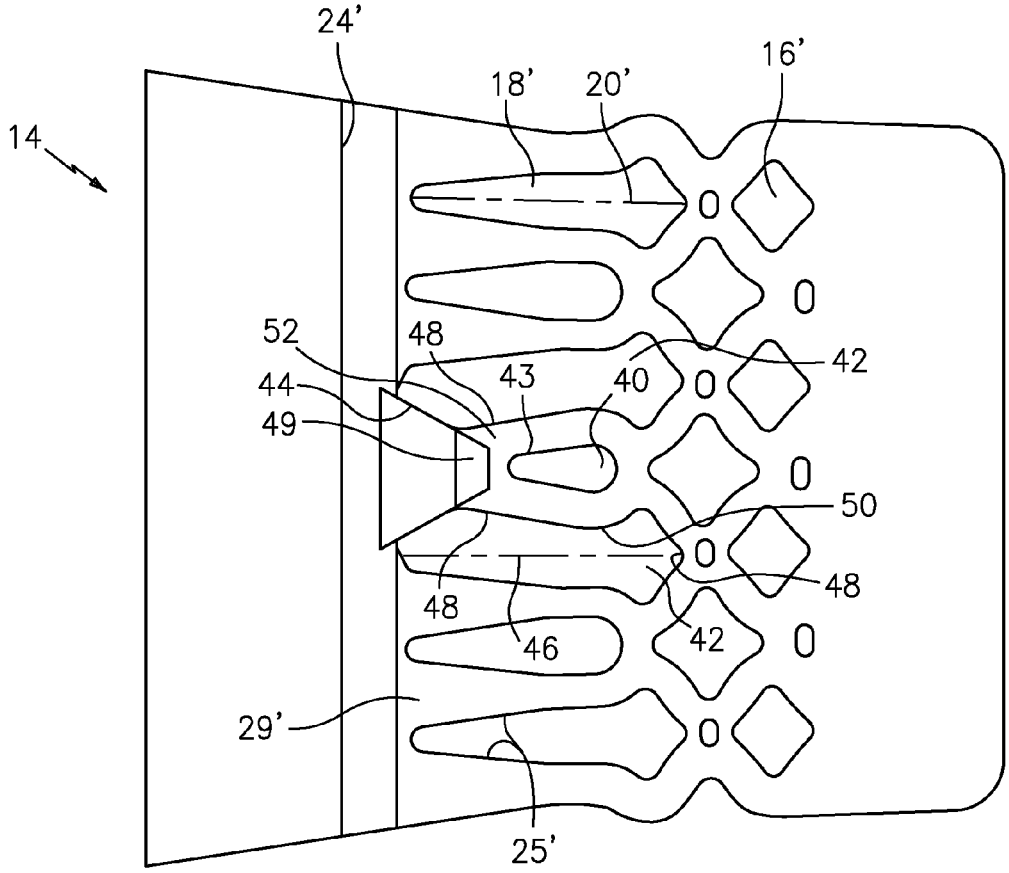
FIG. 4 illustrates a second embodiment of a core for forming a cooling circuit.

Referring now to FIG. 4, there is shown the core 14 which is different in several respects from the core 12. As with core 12, the core 14 has inlet forming features (not shown) which form one or more entrances to the cooling circuit passages and a plurality of metering/tripping features 16'. As before, the metering/tripping features take the form of one or more rows of shaped slots for forming a plurality of protrusions. The core 14 further has a plurality of teardrop features 18' which have a longitudinal axis 20' and are symmetrical about their respective longitudinal axis 20'. The teardrop features 18' are the outermost ones of the teardrops. As before, the teardrop features have converging wall portions 25' which form a series of diverging passageways 29' which terminate in cooling holes 31'(see FIG. 5).

The core 14 differs from the core 12 in that it also has a central teardrop feature 40 and two asymmetrical teardrop features 42 adjacent to the central teardrop feature 40. The central teardrop feature 40 is smaller in size than the teardrop features 18'. It has a trailing edge 43 which is spaced farther from the line 24' than the trailing edges of the other teardrop features 18' and 42. Each of the teardrop features 42 has a longitudinal axis 46 and is asymmetric with respect to said axis 46. Further, each of the teardrop features 42 has a trailing edge 44 which is formed by either a planar surface at an angle to the longitudinal axis 46 or an arcuate surface. The presence of the shorter central teardrop feature 40 creates a space 49 which is bordered by a portion 48 of the sidewalls 50 of the teardrop features 42. The sidewall portions 48 together form a converging fluid passageway 52.

The presence of the space 49 allows a final machining operation which cuts back the space 49 to form a diverging portion to the cooling fluid outlet 54 which enables the cooling flow to be increased as needed. For example, the cooling fluid outlet 54 may be formed using an EDM process. The farther the EDM electrode is pushed into the space 49, the larger the exit of the cooling fluid outlet 54 will be. One of the results of using the core 14 is that the center of the core 14 will have more cooling fluid flow than the sides of the core 14 due to the presence of a cooling fluid outlet 54 which has a converging/diverging shape. The location of the throat portion in the converging/diverging outlet 54 determines the amount of fluid which will flow out of the outlet 54. Further, given the presence of staggered cooling fluid outlets in the final part, extra air will be hitting in areas where the airfoil portion can be cooling challenged.

The cores 14 may be arrayed, as shown in FIG. 1, in a fan type configuration where each core is joined to the ceramic core(s) 80 which form the central cooling fluid passageway (s) in the final airfoil portion.

Each of the cores 12 and 14 may be formed from either a ceramic material or from a refractory metal material.

Figure 5:
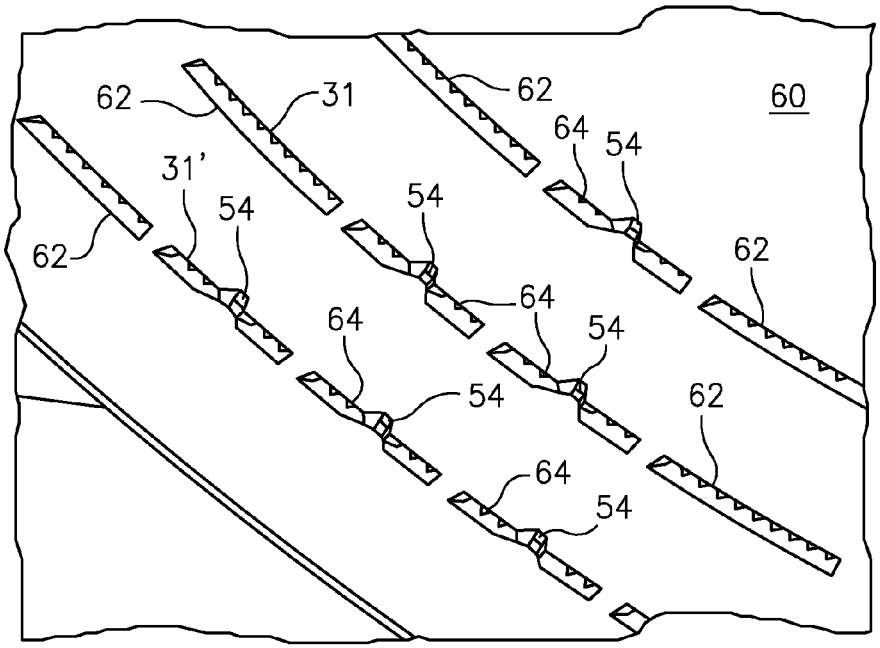
FIG. 5 illustrates an airfoil portion of a turbine engine component with film cooling holes.

Referring now to FIG. 5, there is shown a portion of the airfoil portion 60 of the turbine engine component having a plurality of cooling microcircuits formed within at least one of its walls. As can be seen from this figure, there are two different types of cooling fluid outlet arrays formed by the cores 12 and 14. The outermost array 62 of cooling fluid holes have film cooling holes 31 which are uniformly shaped and sized. The innermost array 64 of cooling fluid holes have a plurality of converging/diverging outlets 54 and a plurality of outer uniformly sized and diverging cooling holes 31'.

Figure 6:
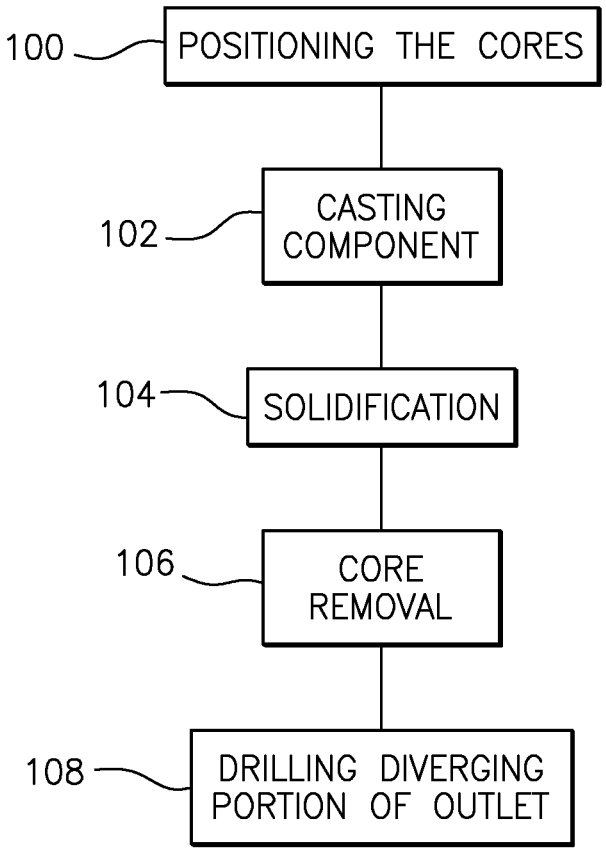
FIG. 6 illustrates a process for forming a turbine engine component.

Referring now to FIG. 6, to form the turbine engine component, in step 100, one forms the arrays 62 and 64 by positioning the cores 12 and 14 in a mold (not shown) in a desired pattern. Each of the cores 12 and 14 may be joined to the ceramic core(s) 80 which form the central cooling passageways in the interior of the airfoil portion 60. In step 102, after the cores 12 and 14 have been positioned in the mold, the turbine engine component with the airfoil portion 60 is formed by casting a metal or metal alloy. The casting technique which is used in step 102 may be any suitable casting technique known in the art. In step 104, the cast material is allowed to solidify. In step 106, following casting and solidification of the metal or metal alloy forming the turbine engine component, the cores 12 and 14 are removed. Removal of the cores may be carried out using any suitable process known in the art such as a chemical leaching process or a mechanical removing process. In step 108, a suitable drilling process, such as EDM, is used to form the diverging portion of the converging/diverging outlets 54. As discussed above, when using an electrode in an EDM technique, the further the electrode used to machine the outlet 54 is pushed into the cast turbine engine component, the larger the exit to the outlet 54 will be.

Figure 7:
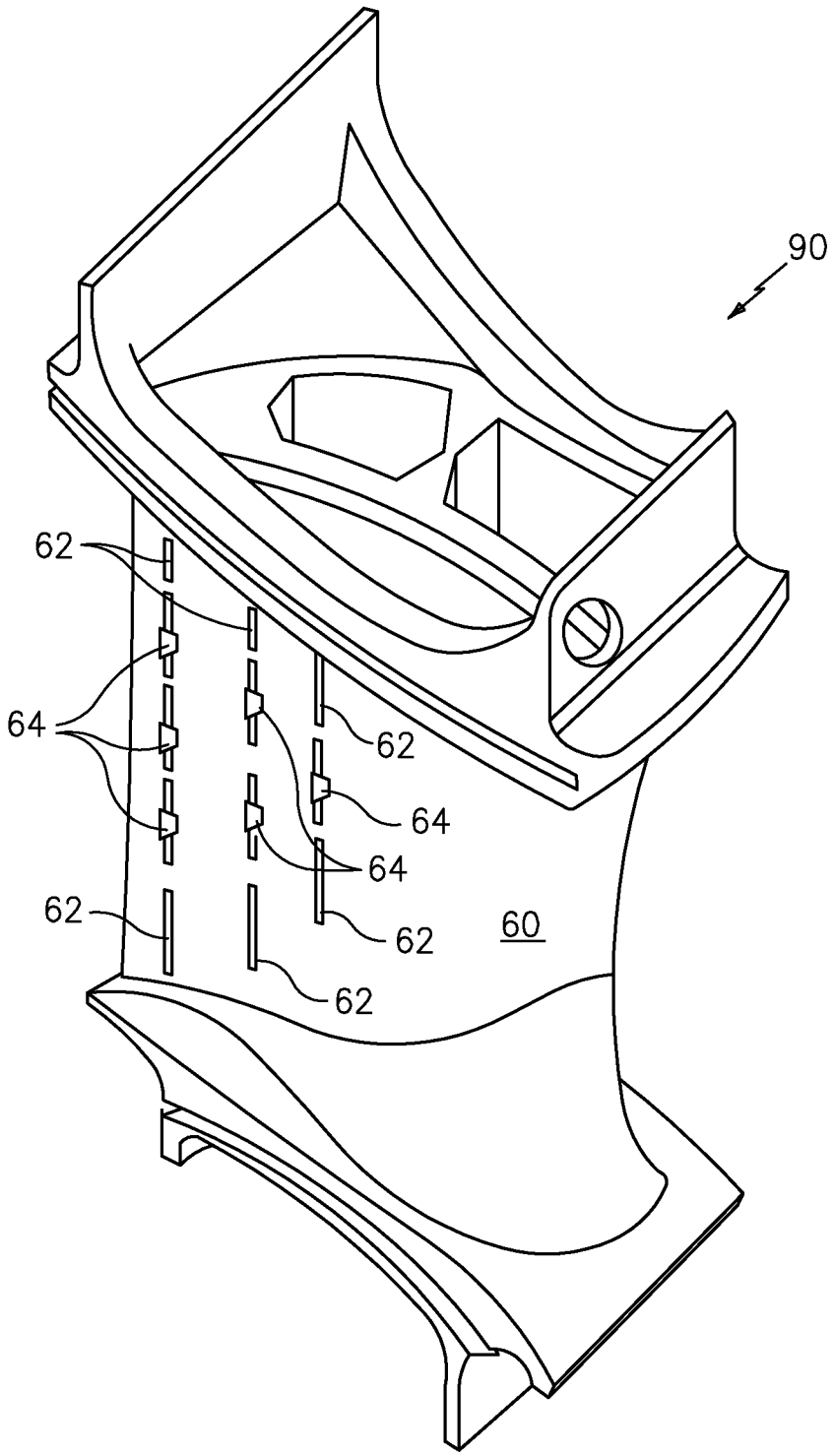
FIG. 7 illustrates a turbine engine component.

FIG. 7 illustrates a turbine engine component 90 having an airfoil portion 60 with the arrays 62 and 64.

The technique described herein for forming the converging/diverging outlets 54 is desirable because it allows one to account for tolerances which occur as dies are used and experience wear and better control the flow of the cooling fluid.

While the converging/diverging outlet 54 has been described as being at the center of the outlet array, the converging/diverging outlet 54 may be offset from the center to create flow as needed.

There has been described in the instant disclosure a drill to flow mini core. While the drill to flow mini core has been described in the context of specific embodiments thereof, other unforeseen alternatives, modifications, and variations may become apparent to those skilled in the art having read the foregoing description. It is intended to embrace those alternatives, modifications, and variations as fall within the broad scope of the appended claims.

What is claimed is:

1. A turbine engine component having an airfoil portion a plurality of cooling microcircuits located within a wall of said airfoil portion, said plurality of cooling microcircuits comprising two different types of cooling fluid outlet arrays comprising:

an outermost array comprising cooling fluid holes, having uniformly shaped and sized film cooling holes; and an innermost array of cooling fluid holes, said innermost array of cooling fluid holes comprising a central outlet and a plurality of outer outlets, said central outlets configured as a converging/diverging cooling outlets and said a plurality of outer outlets configured as uniformly sized and having diverging cooling outlets.

* * * * *